United States Patent [19]

Mitchell, Sr.

[11] Patent Number: 4,920,711

[45] Date of Patent: May 1, 1990

[54] BUILDING CONSTRUCTION SYSTEM

[76] Inventor: Richard F. Mitchell, Sr., 114 Rose St., Waterbury, Conn. 06704

[21] Appl. No.: 271,168

[22] Filed: Nov. 14, 1988

[51] Int. Cl.[5] ..... E02D 1/00

[52] U.S. Cl. ..... 52/169.2; 52/169.3; 52/234; 52/236.5

[58] Field of Search ..... 52/236.5, 169.2, 169.3, 52/234, 79.12, 57, 606

[56] References Cited

U.S. PATENT DOCUMENTS

| | | | |
|---|---|---|---|
| 2,108,065 | 2/1938 | Kotrbaty | 52/236.5 X |
| 2,122,339 | 6/1938 | Dolt | 52/300 X |
| 3,233,346 | 2/1966 | Cornberg | 52/234 X |
| 3,541,744 | 11/1970 | Maxwell | 52/79.12 X |
| 3,587,197 | 6/1971 | Renfro | 52/77.12 X |
| 3,846,946 | 11/1974 | Sandstrom et al. | 52/606 X |
| 4,232,490 | 11/1980 | Doane | 52/234 X |
| 4,577,442 | 3/1986 | Callaway | 52/57 |
| 4,741,131 | 5/1988 | Parker | 52/57 X |
| 4,800,692 | 1/1989 | Jenn | 52/169.2 |
| 4,803,813 | 2/1989 | Fiterman | 52/57 X |

FOREIGN PATENT DOCUMENTS

| | | | |
|---|---|---|---|
| 3009460 | 9/1981 | Fed. Rep. of Germany | 52/234 |
| 11182 | of 1912 | United Kingdom | 52/234 |

*Primary Examiner*—David A. Scherbel
*Assistant Examiner*—Lan Mai
*Attorney, Agent, or Firm*—Richard A. Craig

[57] ABSTRACT

A building construction system provides a building which contains four separate but connected self-standing units each with its own roof and four walls. A member in the shape of a cross extends vertically above the roofs and horizontally beyond the outside walls of adjacent units. The member has two planar arms intersecting each other at right angles along a central vertical axis, thus providing four 90 degree quadrants, each of which contains a different one of the four units.

20 Claims, 6 Drawing Sheets

BUILDING CONSTRUCTION SYSTEM

BACKGROUND OF THE INVENTION

This invention relates to a building construction system which is particularly suited for residential construction, but which is also useful for office and other commercial construction.

It is noteworthy that the inventive system provides a building which is unlike a condominium which is typified by common walls, roofs, driveways and the like.

The inventive construction system provides a building which contains four similar, separate but connected self-standing units, each having its own roof. The system is such that each self-standing unit can also be provided with its own yard and driveway.

Furthermore, the inventive system is extremely economical, not only in terms of construction cost, but also in terms of land utilization. Construction cost for finished units is on the order of $45 per square foot (1988 dollars).

Additionally, the inventive system complies with all known building construction codes.

Important objects of the invention are to provide a building construction system having the foregoing advantages.

The foregoing and additional objects and advantages will become apparent hereinafter.

SUMMARY OF THE INVENTION

The inventive building construction system provides a building which contains four similar separate but connected self-standing units, each with its own roof and walls.

A major component of the system is a member in the shape of a cross which extends vertically through the roof line and horizontally beyond the outside walls of adjacent units. The cross member, which may advantageously be cementitious, has two parallel sided arms intersecting each other at right angles along a central vertical axis, thus providing four 90 degree quadrants, each containing a different one of the four self-standing units.

In terms of residential housing, each unit may be basically 25 feet by 25 feet and each building or system comprising four such units may be basically 53 feet by 53 feet.

DESCRIPTION OF THE INVENTION

Figure 1:
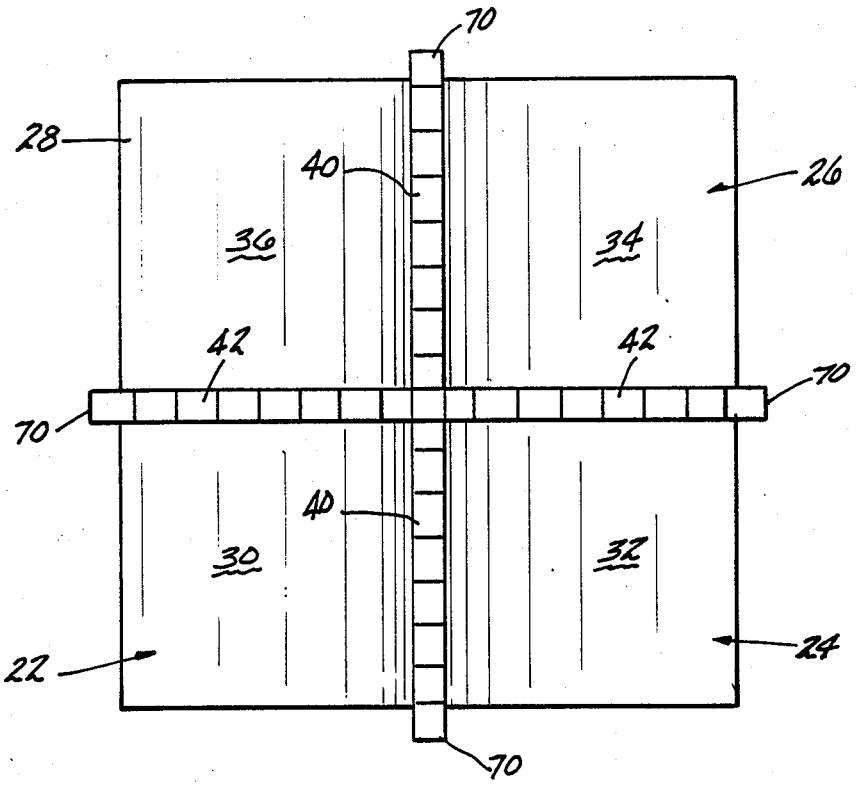
FIG. 1 is a somewhat schematic plan view of a preferred building construction system embodying the invention.

The drawing shows a building construction system which is generally indicated at 20 in FIGS. 1, 2, 6, 7, 8, 9 and 10.

System 20 provides a building containing four separate but connected self-standing units 22, 24, 26 and 28, which will be assumed without limitation to be residential units, it being noted that they could alternatively be commercial units. Each of units 22, 24, 26 and 28 has its own roof, these being roofs 30, 32, 34 and 36, respectively, as to which see FIGS. 1 and 6–10. It is noted that roof 36 of unit 28 appears only in FIG. 1, but roof 36 is in all respects the same as roof 32 of unit 24. Units 22, 24, 26 and 28 will be reverted to and further described hereinafter.

Figure 4:
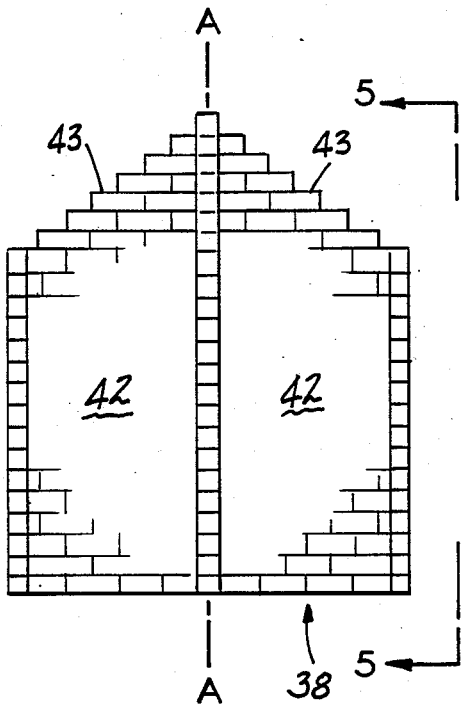
FIG. 4 is a view of the cross shaped member taken on line 4—4 of FIG. 3.
Figure 5:
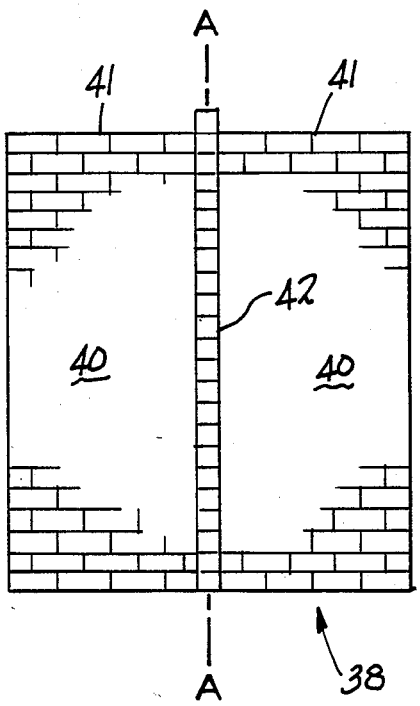
FIG. 5 is a view of the cross shaped member taken on line 5—5 of FIG. 4.
Figure 3:
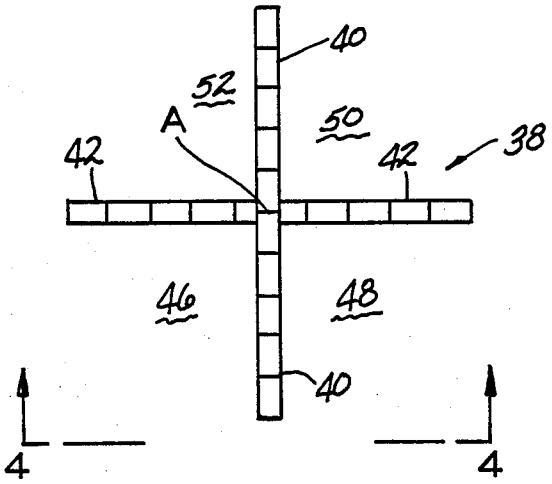
FIG. 3 is a plan view of a cross shaped member which is a major component of the system.

System 20 further includes, for each group of four units 22, 24, 26 and 28, as a major component, a member 38 in the shape of a cross, sometimes referred to hereinafter as cross member 38, which is shown by itself in FIGS. 3, 4 and 5. Cross member 38 is in the form of a parapet, made, for example, of cinderblock or masonry. Cross member 38 is of integral construction and has two parallel sided arms 40 and 42 having upper edges 41 and 43, respectively. Each arm 40 and 42 is 1 foot thick and arms 40 and 42 intersect each other at right angles along a central vertical axis A—A, thus defining four 90 degree quadrants 46, 48 50 and 52 as best seen in FIG. 3.

The ends of arms 40 and 42 are equidistant from axis A—A, being spaced about 26.5 feet therefrom. Thus, each of arms 40 and 42 is about 53 feet long, and each of quadrants 46, 48, 50 and 52 has a dimension of about 26 feet along arm 40 in the direction perpendicular to axis A—A.

The central dimension of cross member 38 along axis A—A for the disclosed residential units 22, 24, 26 and 28 is about 30 feet, as is the vertical dimension of arm 40 everywhere. Thus, as revealed by FIG. 5, arm 40 is rectangular.

The dimension of arm 42 at its ends remote from and parallel to axis A—A is about 18–24 inches. Thus, as revealed by FIG. 4, the portions of arm 42 on opposite sides of arm 40 are mirror images of each other and are in the form of trapezoids, each having two right angles at the bottom and an acute angle at the upper corner adjacent axis A—A. The fourth angle of each trapezoid, at the upper corner remote from axis A—A, is obtuse. The acute angles are the same and the obtuse angles are the same, and the measure of the obtuse angles exceeds the pitch of roofs 30, 32, 34 and 36 by 90 degrees. Typically, the measure of the obtuse angles may be about 110 degrees.

Figure 8:
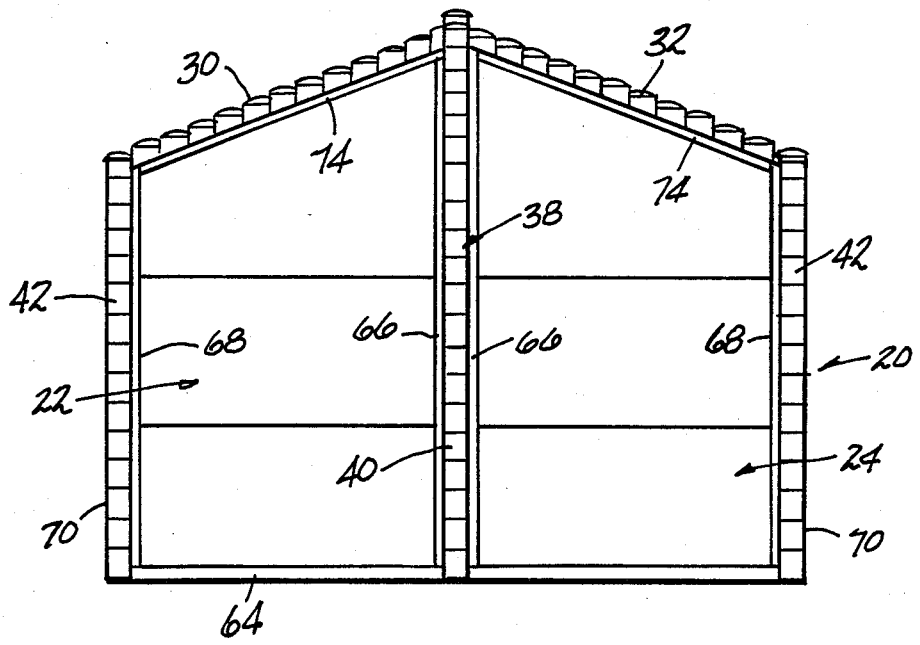
FIGS. 8 and 9 are somewhat schematic views similar to FIGS. 6 and 7, respectively, but showing certain additional details.
Figure 9:
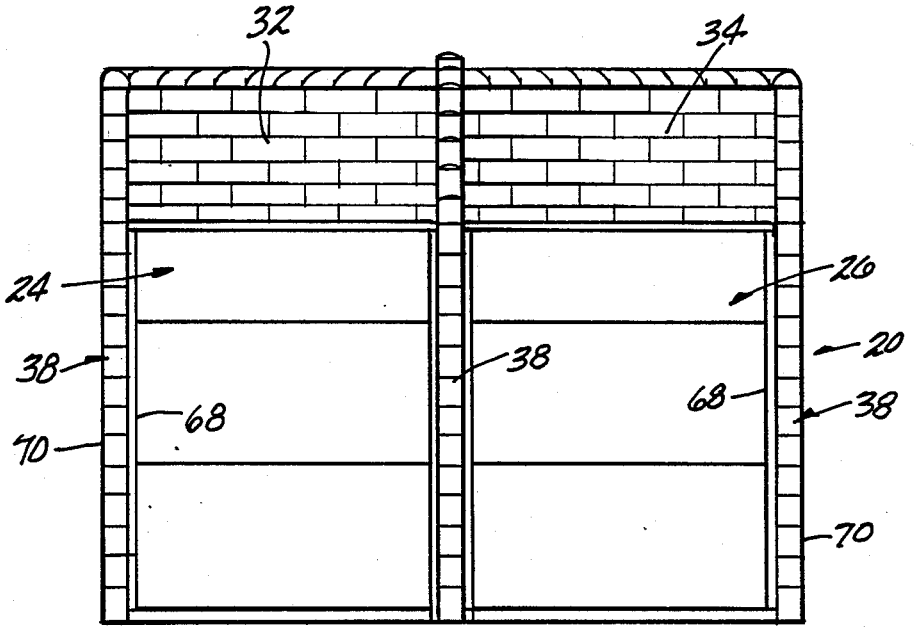
Figure 10:
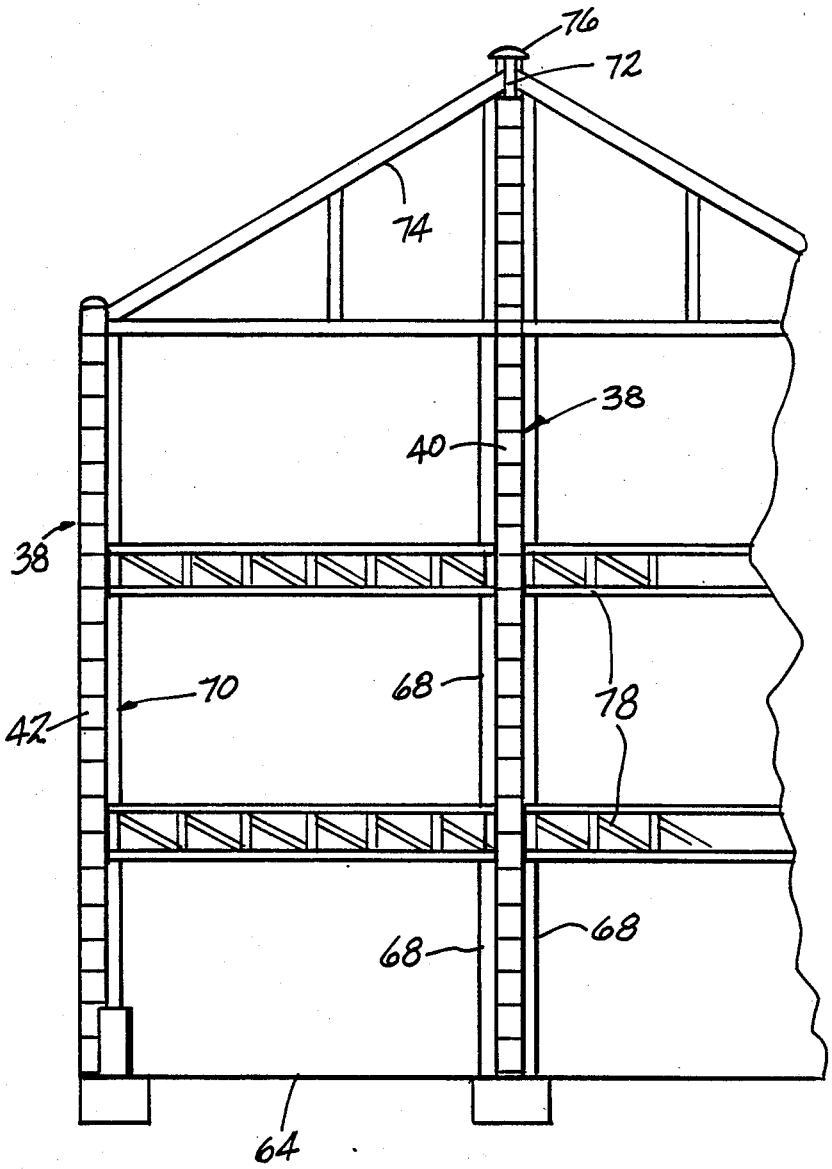
FIG. 10 is an enlarged partly fragmentary view similar to FIG. 8 but showing additional constructional details.

After footings and suitable 4 inch thick slab 64 (FIGS. 8–10) are poured, cross member 38 is erected, and units 22, 24, 26 and 28 are constructed in quadrants 46, 48, 50 and 52, respectively, each such unit utilizing full conventional 2" by 4" framing on 16 inch centers on all four sides as indicated at 66 in FIGS. 8–10, or alternatively "2 by 6" framing or steel or masonry studs or the like. In result, each of units 22, 24, 26 and 28 has two inside unexposed walls 66, one confronting arm 40 and the other confronting arm 42 and two outside exposed walls 68.

It is to be noted that in plan, the outside dimensions of units 22, 24, 26 and 28 are about 25 feet by 25 feet, so that with units 22, 24, 26 and 28 nestled in their respective quadrants 30, 32, 34 and 36, the ends of arms 40 and 42 remote from axis A—A protrude about 1 foot beyond outer walls 68, thereby separating units 22, 24, 26 and 28 from each other. This feature is seen in FIG. 1 and elsewhere at locations identified as 70.

A ridge plate 72, best seen in FIG. 10, is fastened into the horizontal upper surface of arm 40 of cross member 38 or an alternative cross member and extends the length of arm 40. Rafters 74 define roofs 30, 32, 34, and 36 which together provide system 20 with a collective gable roof, it being noted that arms 40 and 42 extend vertically between and above roofs 30 and 32, roofs 32 and 34, roofs 34 and 36, roofs 36 and 30. This completes the isolation of units 22, 24, 26 and 28 from each other. Also, the exposed upper edges of arms 40 and 42 are provides with a coping in the form of tile covers or caps 76, as is ridge plate 72.

Another feature of system 20 is the use of joist trusses 78 in the flooring of units 22, 24, 26 and 28, as shown in FIG. 10.

Figure 6:
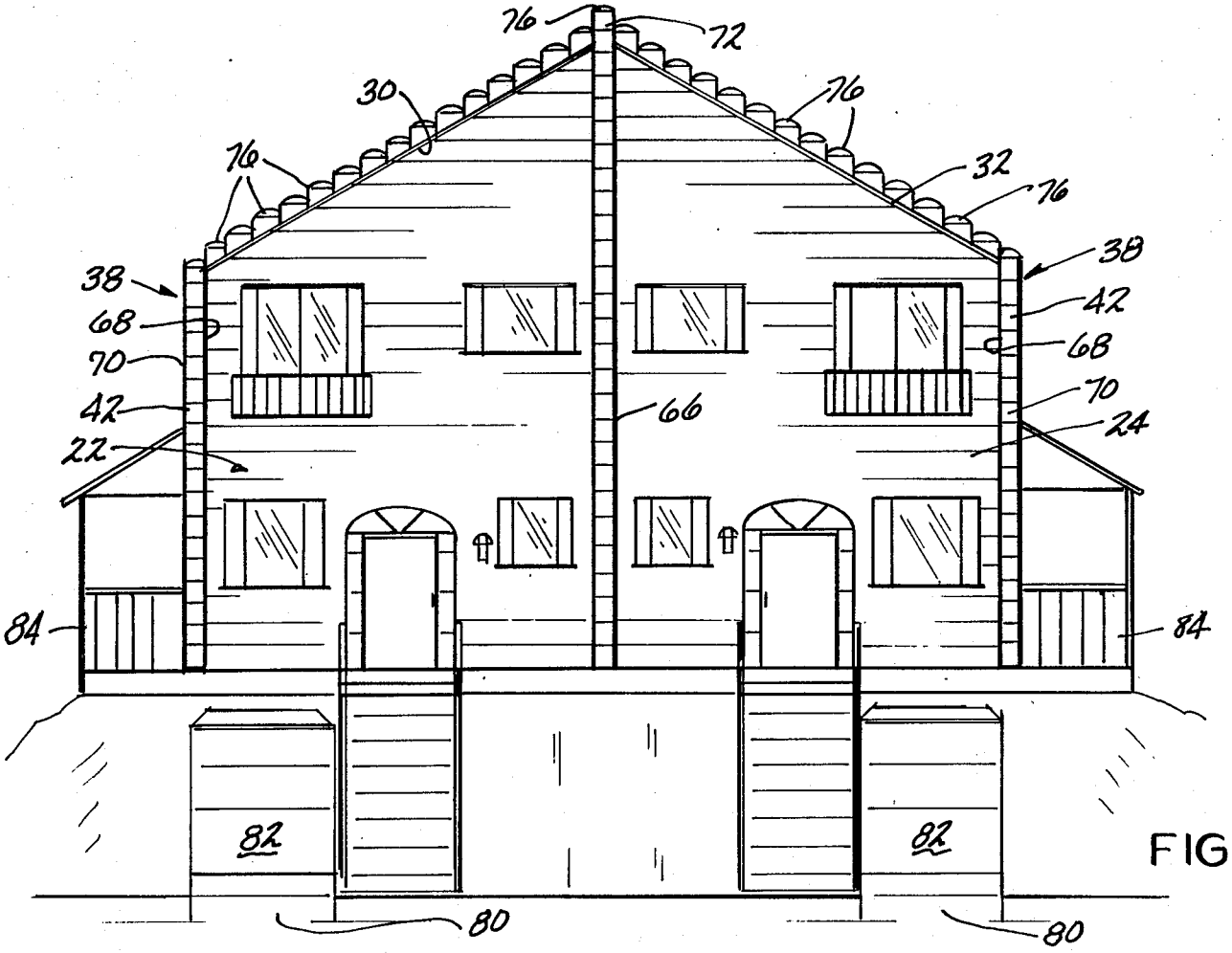
FIG. 6 is a somewhat schematic front elevation of two adjacent units of the system.
Figure 7:
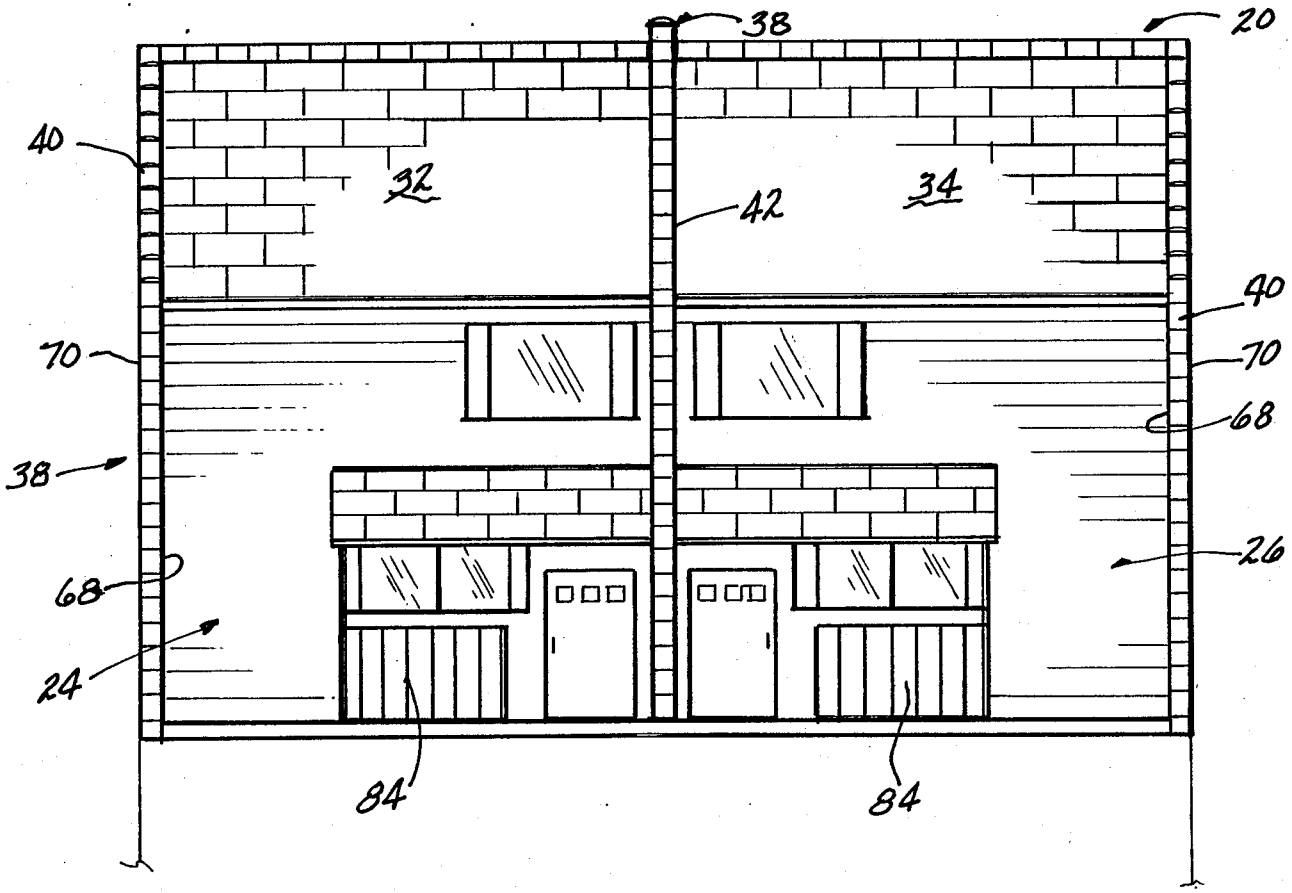
FIG. 7 is a somewhat schematic side elevation of two adjacent units of the system, one such unit being shown also in front elevation in FIG. 6.

Each unit 22, 24, 26 and 28 can be provided with a driveway 80 and a one-car garage, as indicated by garage door 82 in FIG. 6. Also, each unit 22, 24, 26 and 28 can be provided with a deck, as indicated at 84 in FIGS. 6 and 7. Decks 84 protrude slightly beyond the basic 25 feet by 25 feet dimensions of units 22, 24, 26 and 28.

Figure 2:
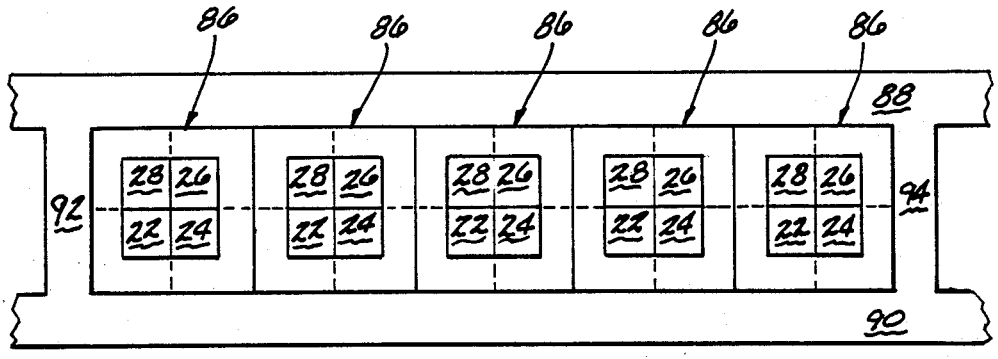
FIG. 2 is a plan view showing placement of five building construction systems of FIG. 1, the five systems together being located on sublots of a lot 500 feet by 100 feet, lying between two parallel streets.

A few further words are in order as to FIG. 2 which is illustrative of the economical utilization of land enabled by the invention. FIG. 2 shows five systems 20 placed on five contiguous sublots 86 each of which measures 100 feet by 100 feet, having been subdivided out of a lot which measures 500 feet by 100 feet, lying between two parallel main streets 88 and 90 100 feet apart and between two parallel cross streets 92 and 94 perpendicular to main streets 88 and 90.

As stated above, the building construction system disclosed herein is extremely economical in terms of construction cost and land utilization and in addition conforms to all known building codes.

It is apparent that the invention will attain all of the stated advantages and others.

The disclosed details are exemplary and are not to be taken as limitations on the invention except as those details may be included in the appended claims.

What is claimed is:

1. A building construction system providing a building structure containing four separate but connected self-standing units each with its won roof and four walls defining a quadrilateral, and a member in the shape of a cross extending vertically above said roofs and horizontally beyond said walls wherein said member has two arms intersecting each other at right angles along a central vertical axis, thus defining four 90 degree quadrants each of which contains a different one of said four units.

2. A system according to claim 1 wherein said arms are parallel sided.

3. A system according to claim 2 wherein two of said four walls of each said unit are outside exposed walls and a different two of said four walls of each said unit confront and are adjacent said arms of said member and are inside unexposed walls.

4. A system according to claim 1 wherein said member is constructed of cinder blocks.

5. A system according to claim 1 wherein said member is constructed of masonry.

6. A system according to claim 3 wherein said inside unexposed walls and said outside exposed walls are provided by framing.

7. A system according to claim 6 wherein said framing is wood framing.

8. A system according to claim 6 wherein said framing is steel studs or masonry.

9. A system according to claim 6 wherein each said unit has a plurality of floors at least some of which are provided by joist trusses.

10. A system according to claim 3 wherein one of said arms of said member has a horizontal upper edge and a ridge plate is secured thereto and extends substantially the length thereof, and said roofs of said units together provide said system with a collective gable roof.

11. A system according to claim 3 wherein said arms of said member have upper edges which are provided with coping therealong.

12. A system according to claim 11 wherein said coping is provided by tile covers.

13. A system according to claim 11 wherein said coping is provided by caps.

14. A system according to claim 1 wherein said units are residential units each of which is basically 25 feet by 25 feet and said system is basically 53 feet by 53 feet.

15. A system according to claim 1 wherein said member extends about 1 foot beyond said walls.

16. A system according to claim 1 wherein said member extends about 1 foot above said roofs.

17. A system according to claim 2 wherein one said arm is rectangular and has a horizontal upper edge and the other said arm has portions on opposite sides of said axis which are mirror images of each other and are in the form of trapezoids each having two right angles at the bottom, an acute angle at the upper corner adjacent said axis and an obtuse angle at the upper corner remote from said axis.

18. A system according to claim 17 wherein said obtuse angles are the same and the measure of each said obtuse angle exceeds the pitch of each said roof by 90 degrees.

19. A system according to claim 1 wherein each said quadrilateral is a rectangle.

20. A system according to claim 19 wherein each said rectangle is a square.

* * * * *